US007280639B2

(12) United States Patent
Hörnig

(10) Patent No.: US 7,280,639 B2
(45) Date of Patent: Oct. 9, 2007

(54) ROTARY PISTON X-RAY TUBE WITH THE ANODE IN A RADIALLY ROTATING SECTION OF THE PISTON SHELL

(75) Inventor: Mathias Hörnig, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 187 days.

(21) Appl. No.: 11/167,028

(22) Filed: Jun. 24, 2005

(65) Prior Publication Data

US 2005/0286684 A1 Dec. 29, 2005

(30) Foreign Application Priority Data

Jun. 25, 2004 (DE) ..... 10 2004 030 832

(51) Int. Cl.
*H01J 35/10* (2006.01)

(52) U.S. Cl. ..... 378/144; 378/130; 378/137

(58) Field of Classification Search ..... 378/125, 378/137, 144, 130
See application file for complete search history.

(56) References Cited

U.S. PATENT DOCUMENTS 2,900,543 A * 8/1959 Heuse ..... 378/130
3,842,305 A * 10/1974 Braun ..... 378/127
4,229,657 A * 10/1980 Bensussan et al. ..... 378/125
4,250,425 A * 2/1981 Gabbay et al. ..... 378/125
4,788,705 A * 11/1988 Anderson ..... 378/121
6,084,942 A * 7/2000 Hell et al. ..... 378/200
6,339,635 B1 1/2002 Schardt et al.
6,426,998 B1 7/2002 Hell et al.
6,735,283 B2 * 5/2004 Kutschera et al. ..... 378/144
6,907,110 B2 * 6/2005 Apel et al. ..... 378/143
6,947,522 B2 * 9/2005 Wilson et al. ..... 378/125

FOREIGN PATENT DOCUMENTS

EP 0 768 699 4/1997

* cited by examiner

*Primary Examiner*—Edward J. Glick
*Assistant Examiner*—Thomas R. Artman
(74) *Attorney, Agent, or Firm*—Schiff Hardin LLP

(57) ABSTRACT

A rotary piston x-ray tube has a piston formed by a case wall and support such that it can rotate around a rotational axis. The piston contains a cathode and an anode. To improve cooling, the anode of the rotary piston x-ray tube forms a radially-rotating section of the shell wall.

14 Claims, 3 Drawing Sheets

Prior art

ROTARY PISTON X-RAY TUBE WITH THE ANODE IN A RADIALLY ROTATING SECTION OF THE PISTON SHELL

BACKGROUND OF THE INVENTION

1. Field of the Invention

The present invention concerns a rotary piston x-ray tube.

2. Description of the Prior Art

Rotary piston x-ray tubes are known, for example, from U.S. Pat. Nos. 6,426,998 and 6,339,635. An anode formed as an anode plate is disposed opposite a cathode in these known rotary piston x-ray tubes. The anode forms a base of the piston of the rotary piston x-ray tube. In the operation of the rotary piston x-ray tube, an electron beam emanating from the cathode strikes a stationary focal spot in the edge region of the anode plate. By rotation of the piston, the focal spot describes a circular focal path on the anode plate.

The heat formed by the absorption of the electrons is dissipated to a coolant via the back side of the anode plate facing away from the cathode. Given a constant radiation capacity, the heating of the anode is primarily determined by the rotational spread of the rotary piston x-ray tube as well as by the radius of the focal path. The largest possible radius of the focal path is structurally limited by the diameter of the anode plate.

Increasing the radiation capacity of the rotary piston x-ray tube leads to an increased heat entry into the anode. Since the cooling capacity of the anode is limited, for example by the maximum rotational speed, the radiation capacity of the rotary piston x-ray tube cannot be increased without further measures.

The rotational speed frequency of the rotary piston x-ray tube is limited by its moment of inertia. The massively designed anode with the anode plate contributes a significant proportion of the moment of inertia. An increase of the rotational speed for reduction of the heating of the anode is possible only to a certain degree.

SUMMARY OF THE INVENTION

An object of the present invention is to avoid the aforementioned disadvantages of the prior art. In particular a rotary piston x-ray tube with improved cooling of the anode should is achieved. A further object is to provide a rotary piston x-ray tube with an increased radiation emission capacity, while improving the lifespan.

This object is achieved by a rotary piston anode tube wherein the anode forms a radially rotating section of a wall of the piston shell or housing. It is thereby possible to enlarge the radius and thus the length of the focal path. In particular the contact surface of the anode that faces the coolant is thereby enlarged. As a result, heat can be better dissipated from the anode, and therewith the radiation capacity of the rotary piston x-ray tube can be increased. In addition to this, the lifespan of the rotary piston x-ray tube can be increased.

Furthermore, the rotary piston x-ray tube can be constructed with a lower mass. Instead of a massively-fashioned anode, the shell wall of the piston can be used as a cooling body. As a result, the moment of inertia of the piston can be decreased. The maximum rotational speed can be increased and the cooling of the anode can be further improved. Apart from this, the length of the piston and thus the space requirement of the rotary piston x-ray tube can be reduced.

Furthermore, the base of the piston is not occupied by the anode. It is possible to utilize the base for functional purposes. In comparison with conventional rotary piston x-ray tubes, it is possible to modify or to improve the arrangement of components of the rotary piston x-ray tube. Additional components such as, for example, an arrangement for deflecting electron beam can be mounted on the base.

In an embodiment of the invention, the rotating section is located in the region of the maximum radius of the shell wall. Heating of the focal path and thermal loading of the anode can thereby be reduced and the lifespan of the rotary piston x-ray tube increased. Sections of the shell wall can advantageously be provided with smaller radii than the maximum radius. A rotary piston x-ray tube with smaller moment of inertia can be rotated with a higher rotational speed. The cooling of the anode and of the focal ring can be improved.

In a further embodiment, the shell wall has a frustrum-shaped region. The shell wall can also have a cylindrical region. The regions are particularly simple geometric shapes for the manufacture of the shell wall. Cylindrical regions with different radii can also be connected by frustrum-shaped regions. Pistons thus can be produced with optimally small moment of inertia.

According to a further embodiment of the invention, the anode can be cylindrical or frustrum-shaped. Rotary piston x-ray tubes with different angles of incidence of the electron beam on the anode thus can be produced. Furthermore, it is possible to vary the irradiation direction of the x-ray radiation by a suitable geometry of the anode. For example, rotary piston x-ray tubes can be produced that radiate x-ray radiation in a direction parallel to the rotational axis or also a direction at an angle thereto. The frustrum is thereby opened in the direction parallel to the axis. If the frustrum is opened opposite to this direction, a rotary piston x-ray tube can be produced that radiates x-ray radiation in the opposite direction.

In another embodiment of the invention, the shell wall is cooled at its exterior. The shell wall can be cooled as a whole or only in the region of the anode. The cooling can be a direct cooling in which the exterior is charged with a coolant such as a liquid. The heat dissipation can be improved by utilization of the rotation of the piston. The exterior surface can be enlarged by a co-rotating structure, for example grooves, webs and the like on the exterior surface of the shell wall, the exterior surface can be advantageously enlarged, the coolant can be circulated and an improved heat dissipation can be achieved. An effective cooling enables the maintenance intervals as well as the lifespan of the rotary piston x-ray tube to be lengthened.

According to a further embodiment, a section of the piston has a focusing element for focusing the electron beam emanating from the cathode. The focusing element is preferably mounted on the base of the piston. A more precise focusing of the electron beam thus can be achieved. The radiation pattern of the x-ray radiation can be improved.

According to a further embodiment, the anode has a layer made from a high-melting-point material. Such materials exhibit melting points up to approximately 4000° C. Materials such as, for example, graphite preferably are used. The anode can furthermore have an x-ray-emissive layer that, for example, can be produced from Wo, Mo, Re or a Wo—Rh alloy. The characteristic (such as, for example, the wavelength or characteristic radiation) of the x-ray radiation can be established by the x-ray-emissive layer. The remaining part of the anode can be produced from a good heat-dissipating material that can be connected in a simple manner with the material of the shell wall and the x-ray-emissive layer. The anode preferably exhibits a thickness in the range of 10 to 20 mm; the x-ray-emissive layer preferably exhibits a thickness in the range of 0.5 mm to 1.5 mm. Such thicknesses are sufficient to prevent a melting of the materials by the electron beam and to ensure an optimally complete absorption of the electrons and a best-possible conversion of the energy of the electrons into x-ray radiation.

According to a further embodiment of the invention, the shell wall has a section produced from aluminum. Aluminum is particularly well-suited for manufacture of the shell wall of the piston. It exhibits a low atomic mass and a high heat conductivity. Furthermore, the shell wall can be produced from a non-magnetic material. Non-magnetic materials such as, for example, aluminum or stainless steel are particularly suited for rotary piston x-ray tubes in which the electron beam is deflected by electromagnetic fields. Non-magnetic materials do not interfere with the magnetic field that is externally applied to the piston for deflection of the electron beam, and allow an exact deflection of the electron beam. By a suitable selection of the materials for manufacture of the shell wall, its properties can be adapted to the requirements for a specific use of the rotary piston x-ray tube. For example, by the use of stainless steel the mechanical stability of the shell wall can be improved. Materials with good heat conductivity, for example aluminum, are particularly suited for production of pistons with small moments of inertia. These can be rotated with a higher rotational speed, so the cooling of the anode can be improved. The thickness of the shell wall is preferably in the range between 1 mm and 3 mm.

According to a further embodiment, the anode extends only over a segment of the thickness of the shell wall. The heat can be dissipated at the externally cooled shell wall. The heat dissipation from the anode to the shell wall can be increased by an optimally good coupling, for example with a heat conduction paste.

The anode can be inserted into a groove located on the inside of the shell wall. The manufacture of the rotary piston x-ray tube, in particular the fixing of the anode in the piston, can thereby be simplified.

DESCRIPTION OF THE PREFERRED EMBODIMENTS

Figure 1:
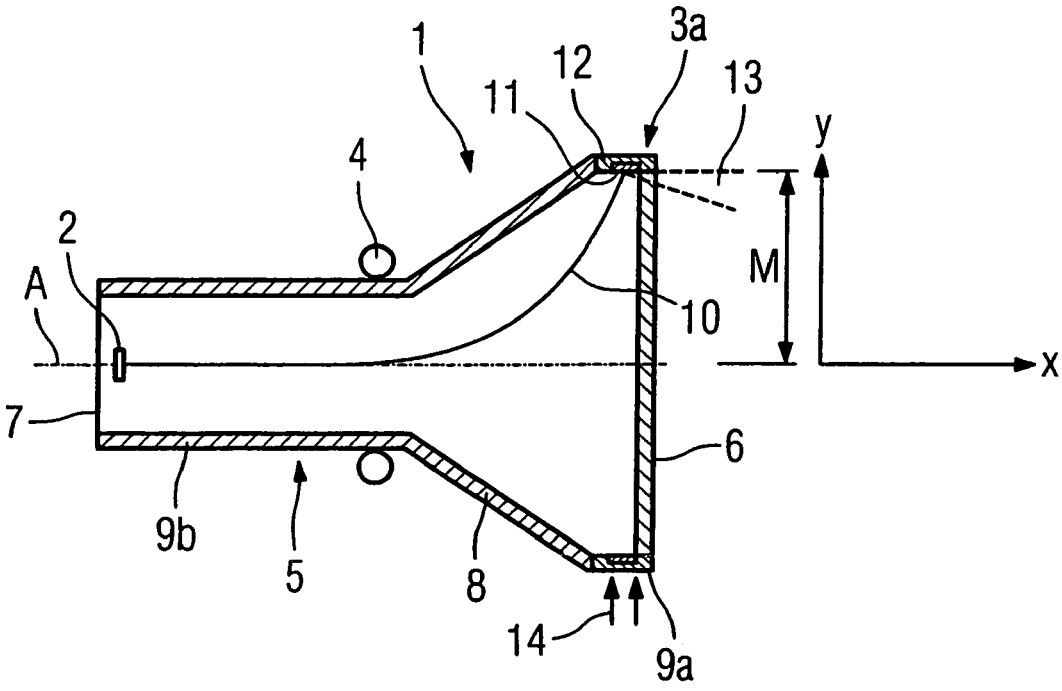
FIG. 1 is a sectional view of the piston of a rotary piston x-ray tube in accordance with the invention, with a first embodiment of a cylindrically-fashioned anode.

FIG. 1 shows a sectional view of a piston 1 of a rotary piston x-ray tube supported by a bearing arrangement 4 such that it can rotate around a rotational axis A. The piston 1 contains a cathode 2 and an anode 3*a* in an evacuated volume enclosed by a piston shell wall 5 and a first piston base 6 and a second piston base 7. The sectional view lies in a plane containing the rotational axis A. The anode 3*a* forms a first cylindrical section 9*a* of the shell wall 5. The shell wall 5 furthermore has a frustrum-shaped section 8 and a second cylindrical section 9*b*. An electron beam 10 emanates from the cathode 2. The electron beam 10 strikes an x-ray emissive first layer 11 of the anode 3*a* at a radial distance M from the rotational axis A. The x-ray-emissive first layer 11 is mounted on a high-melting-point second layer 12 (made, for example, from graphite) with good heat conductivity. X-rays radiating from the anode 3*a* are designated with the reference character 13. The anode 3*a* has an outer surface 14 that is charged with coolant (not shown here) for cooling. The x- and y-directions lying in the section plane are also indicated.

The operation of the rotary piston x-ray tube of FIG. 1 is as follows:

During operation of the rotary piston x-ray tube, an electron beam 10 emanates from the cathode 2 located in the vacuum-sealed piston 1. Electromagnetic fields generated by a beam deflector arrangement (not shown), deflect the electron beam 10 such that it strikes the approximately 1 mm-thick, x-ray-emissive first layer 11 (produced, for example, from Wo, Mo or Re) of the first anode 3*a*. The electron beam 10 strikes on the first layer 11 in a focal spot (not designated) that is stationary relative to the rotational axis A. Due to the rotation of the piston 1 of the rotary piston x-ray tube, the focal spot describes a focal path on the first layer 11. Heat is generated by absorption of electrons of the electron beam 10, causing the first anode 3*a* to become substantially elevated in temperature. The heat is dissipated via the second layer 12 (for example, approximately 2 mm thick, produced from graphite) to the outer surface 14 of the piston 1. The outer surface is charged with a coolant (not shown) and is thereby directly cooled. The focal path is located in a region with the maximum radius of the piston 1. The first radial distance M corresponds to the maximum radius of the piston 1. A largest-possible length and area of the focal path thereby result. The temperature and the thermal loading of the anode 3*a* and of the bordering material (for example produced from aluminum or stainless steel) and the shell wall 5 are reduced. The lifespan and the maintenance intervals of the rotary piston x-ray tube can be increased.

The shell wall 5 includes the frustrum-shaped section 8 and the second cylindrical section 9*b*. Both sections 8 and 9*b* are closer to the rotational axis A than the first cylindrical section 9*a* containing the anode 3*a*. The moment of inertia of the piston 1 can be minimized by designing the shell wall 5 to the rotational axis A. The rotational speed of the piston 1 can be increased, and thus the focal ring temperature can be reduced.

The rotation of the piston 1 can be utilized in order to achieve an optimally good contact and heat transfer between the outer surface 14 and the coolant. Furthermore, the outer surface can be structured, for example with grooves or webs. The outer surface 14 effectively available for cooling can thereby be enlarged. Moreover, with a suitably-structured outer surface 14 it is possible to optimally circulate the coolant by utilizing the rotation and to achieve an optimally advantageous dissipation of the heat. The anode 3*a* including the focal path is cylindrically fashioned in the shown rotary piston x-ray tube. The emission of the x-ray radiation 13 ensues in the x-direction essentially parallel to the rotational axis A. The aperture angle of the emitted x-ray radiation 13 is determined by the angle of incidence of the electrons on the x-ray-emissive first layer 11. The radiation is itself limited in the y-direction by the anode 3*a*.

The deflection arrangement (not shown) for deflection of the electron beam 10 can be mounted on the first piston base 7 not occupied by the anode 3*a*. Such deflection arrangement enables a particularly precise positioning of the focal spot.

In FIGS. 2 through 5, functionally similar elements of the rotary piston x-ray tube are designated with reference characters analogous to those in FIG. 1, insofar as nothing different is specified.

Figure 2:
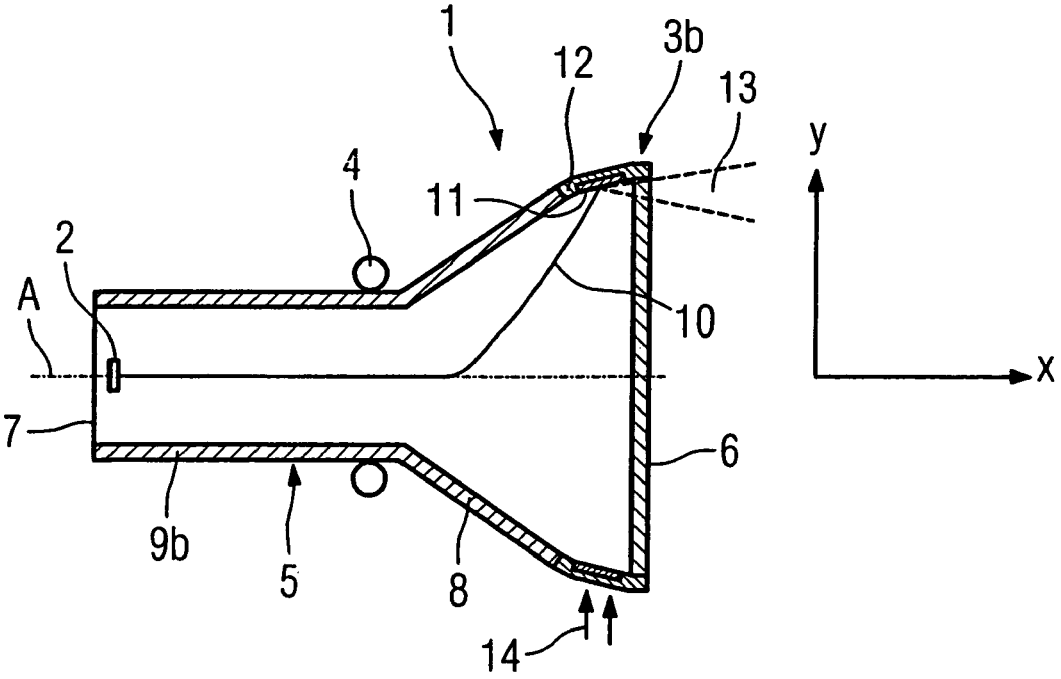
FIG. 2 is a sectional view of the piston of a rotary piston x-ray tube in accordance with the invention, with an anode fashioned in the shape of a frustrum.

FIG. 2 shows a sectional view through a piston 1 of a rotary piston x-ray tube. The sectional view lies in a plane analogous to FIG. 1. In contrast to FIG. 1, the rotary piston x-ray tube of FIG. 2 has an anode 3*b* fashioned in the shape of a frustrum. The cone belonging to the frustrum is opened in the x-direction x.

Figure 3:
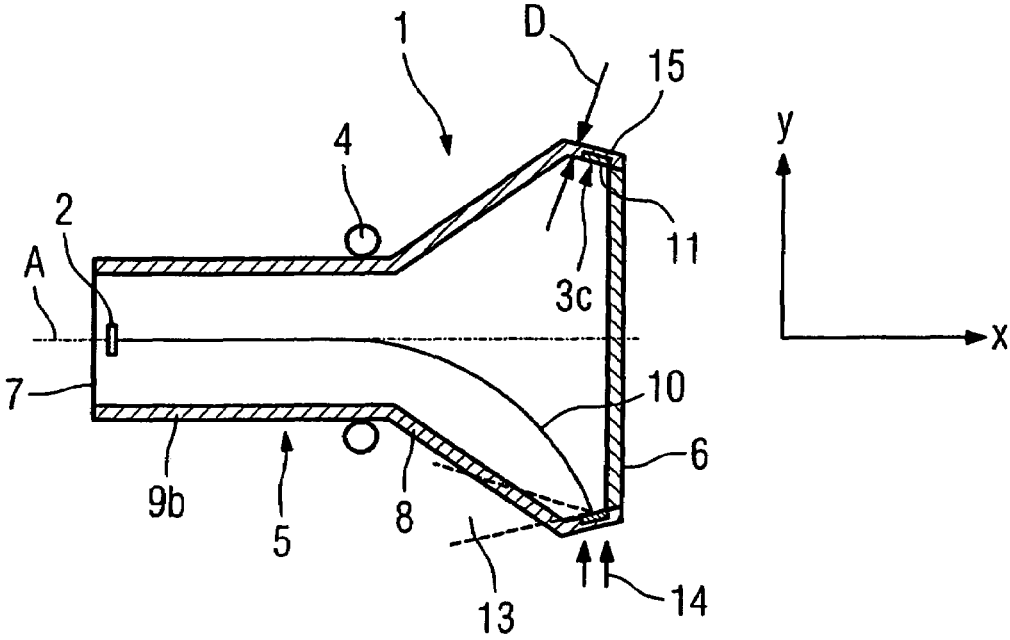
FIG. 3 is a sectional view of a piston of a rotary piston x-ray tube in accordance with the invention with an anode fashioned in the shape of a frustrum.

FIG. 3 shows a sectional view, analogous to FIG. 2, of a piston 1 of a rotary piston x-ray tube. The rotary piston x-ray tube has an anode 3*c* fashioned in the shape of a frustrum. The third anode 3*c* is formed only by the x-ray-emissive first layer 11. The third anode 3*c* is counter-sunk into a groove 15 of the shell wall 5 of the piston 1. The thickness of the shell wall 5 is designated.

In the rotary piston x-ray tube shown in FIG. 3, the anode 3*c* and thus the focal path thereof are in the shape of a frustrum. The cone belonging to the frustrum opens opposite to the x-direction. In contrast to FIG. 2, the x-ray radiation is emitted opposite to the positive x-direction. The pattern of the emitted x-ray radiation 13 corresponds substantially to that of FIG. 2. The anode 3*c* is counter-sunk into the groove 15 and does not extend through the entire thickness D of the shell wall 5 as in, for example, FIG. 1 or FIG. 2. The anode 3*c* is fixed to the shell wall 5 by the groove 15. The heat generated in the absorption of the electrons is dissipated from the anode 3*c* through the shell wall 5 to the outer surface. The cooling of the shell wall 5 on the outer surface 14 ensues via a coolant (not shown).

Figure 4:
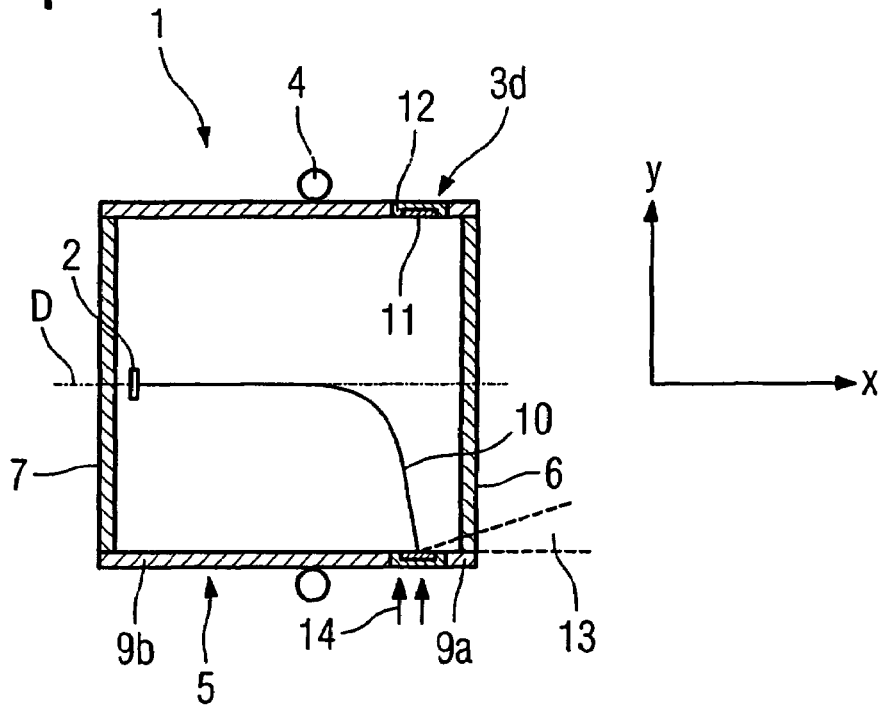
FIG. 4 is a sectional view of a cylindrically-fashioned piston of a rotary piston x-ray tube in accordance with the invention with a second embodiment of a cylindrically-fashioned anode.

FIG. 4 shows a sectional view of a rotary piston x-ray tube, wherein the shell wall 5 of the piston 1 and the anode 3*d* are cylindrical.

Such a piston 1 is particularly simple to manufacture. No cylindrical sections need to be manufactured for the shell wall 5. The shell wall 5 has a more stable structure. Furthermore, in comparison with FIG. 1 through 3 it can be seen that the piston 1 of the rotary piston x-ray tube is more compact. This compact design allows a wider usage range of the rotary piston x-ray tube of FIG. 4.

Figure 5:
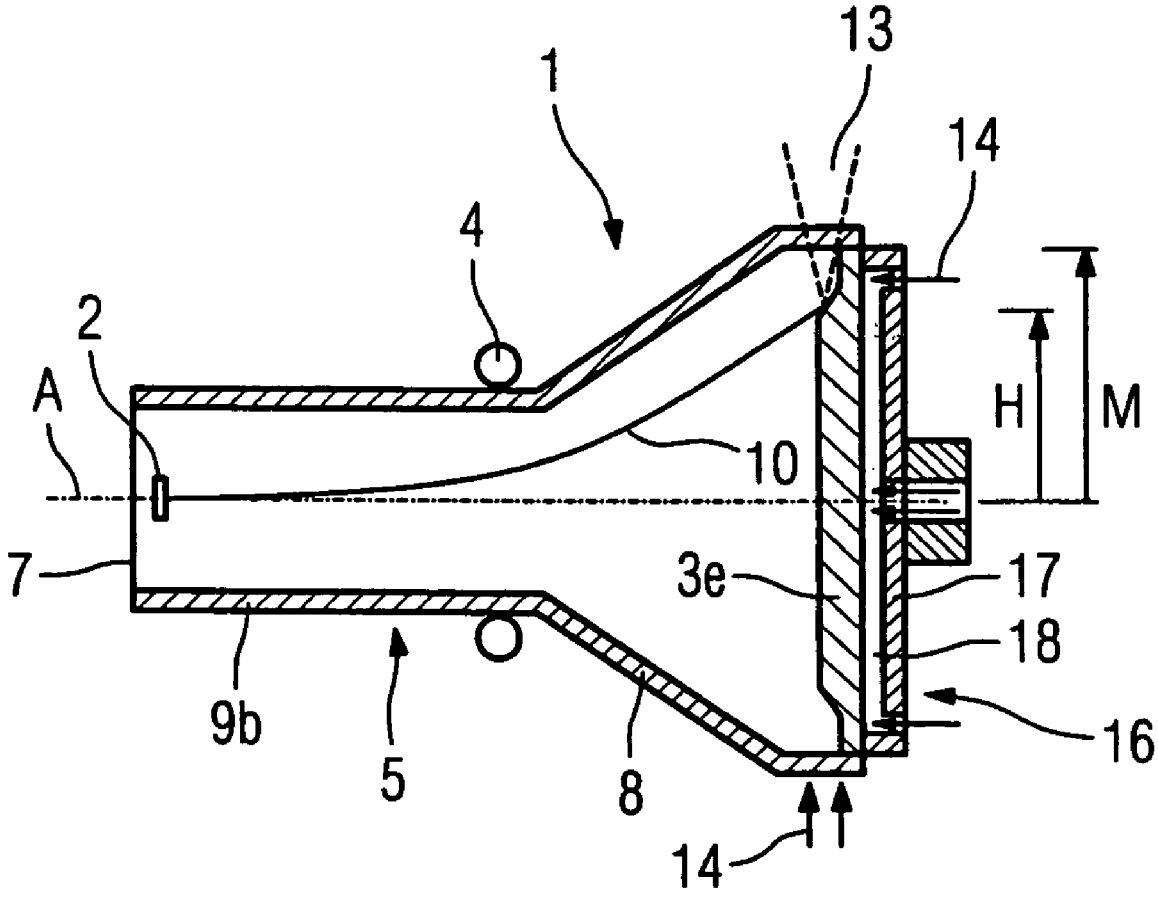
FIG. 5 is a sectional view of the piston of a conventional rotary piston x-ray tube with a plate-shaped anode.

FIG. 5 shows a sectional view of a rotary piston x-ray tube according to the prior art, with a plate-shaped anode 3*e*. The plate-shaped anode 3*e* is mounted opposite the cathode 2. In contrast to FIG. 1 through 4, the anode 3*e* of FIG. 5 forms the first piston base 6 of the piston 1. The electron beam 10 emanating from the cathode 2 strikes the anode 3*e* in a focal spot. X-ray radiation 13 emanates from the anode 3*e* in a radial direction. The reference character H designates the radial separation of the focal spot from the rotational axis. The inventive radial separation M of FIG. 1 is shown for comparison. The anode 3*e* has a cooling body 17 with a vertically-running channel 18 on a back side 16 facing away from the cathode 2.

The dimensions of the shell wall 5 of the rotary piston x-ray tube of FIG. 5 correspond to those of FIG. 1. Cooling of anode 3*e* ensues via the back side 16 of the anode 3*e*. The anode material dissipates heat from the anode 3*e* to a coolant circulated through the channel 18. The cooling surface is limited by the radius of the anode 3*e*. A cooling surface of approximately 314 $cm^2$ results given a radius of approximately 10 cm. In contrast to this, if a 10 cm-wide section of the shell wall 5 of the piston 1 of FIG. 1 is cooled, a cooling surface of approximately 408 $cm^2$ ($2*\pi*10$ cm$*6.5$ cm) can be achieved with the same geometry and the dimensions. The cooling surface of the piston 1 of the inventive rotary piston x-ray tube of FIG. 1 is approximately 30% larger than that of the conventional rotary piston x-ray tube of FIG. 5. The cooling of the anode can be markedly improved.

In the rotary piston x-ray tube of FIG. 5, the radial separation H of the focal spot from the rotational axis A is smaller than the radial separation M of FIG. 1. The surface of the focal spot generated by the rotation of the piston is smaller. If B designates the diameter of the focal spot, $$BF5=2\pi*H*B$$

results for the focal ring area BF5 of FIG. 5 and $$BF1=2\pi*M*B$$

for the focal ring area of FIG. 1.

A negligible enlargement of the radius of the focal spot from the rotational axis A, for example from the second radial separation H of the conventional rotary piston x-ray tube to the radial separation M of the inventive rotary piston x-ray tube already leads to a significant enlargement of the focal ring area. For example, if H=10 cm, M=11 cm and B=2 mm, the area of the focal ring can be enlarged by approximately 10%. Associated with this is a reduction of the focal ring temperature and the thermal load of the anodes 3*a* through 3*d*. It is in particular possible to increase the capacity of the rotary piston x-ray tube with the same thermal load.

In comparison to the conventionally-arranged anode of FIG. 5, the cooling of the inventive arrangements of the anodes according to FIG. 1 through 4 can clearly be improved significantly by a larger cooling and focal ring area.

Although modifications and changes may be suggested by those skilled in the art, it is the intention of the inventor to embody within the patent warranted hereon all changes and modifications as reasonably and properly come within the scope of his contribution to the art.

I claim as my invention:

1. A rotary piston x-ray tube comprising:

a rotary piston comprising a first piston base and a second piston base and a continuous shell wall extending between and connecting said first piston base and said second piston base, said shell wall having a frustrum-shape with a region of maximum radius;

said rotary piston enclosing an evacuated volume and containing an anode and a cathode in said evacuated volume, said cathode emitting an electron beam;

said rotary piston being supported for rotation around a rotational axis and said anode forming a radially-rotating section of said shell wall disposed in said region of maximum radius;

a deflector disposed along said shell wall between said cathode and said anode, said deflector interacting with said electron beam to deflect said electron beam from said cathode onto said anode, said electron beam striking said anode and causing emission of x-rays from said anode as well as generation of heat at said anode; and said shell wall having an exterior surface at said region of maximum radius that is exposed to allow direct interaction of said exterior surface with a coolant, said exterior surface being in thermal communication with said anode and promoting transfer of said heat from said anode to said coolant.

2. A rotary piston x-ray tube as claimed in claim 1 wherein said shell wall comprises a cylindrical region adjacent to said frustum-shaped region.

3. A rotary piston x-ray tube as claimed in claim 1 wherein said anode is cylindrical.

4. A rotary piston x-ray tube as claimed in claim 1 wherein said anode has a frustrum shape.

5. A rotary piston x-ray tube as claimed in claim 1 wherein said anode comprises a layer of a material having a high melting point.

6. A rotary piston x-ray tube as claimed in claim 5 wherein said anode additionally comprises an x-ray emissive layer on said layer of a material with a high melting point.

7. A rotary piston x-ray tube as claimed in claim 6 wherein said x-ray emission layer is comprised of a material selected from the group consisting of tungsten, molybdenum and rhenium.

8. A rotary piston x-ray tube as claimed in claim 1 wherein said anode has a thickness in a range between 10 mm to 20 mm.

9. A rotary piston x-ray tube as claimed in claim 8 wherein said anode comprises an x-ray emissive layer having a thickness in a range between 0.5 mm to 1.5 mm.

10. A rotary piston x-ray tube as claimed in claim 1 wherein said shell wall comprises a section comprised of aluminum.

11. A rotary piston x-ray tube as claimed in claim 1 wherein said shell wall is comprised of a non-magnetic material.

12. A rotary piston x-ray tube as claimed in claim 11 wherein said non-magnetic material is selected from the group consisting of aluminum and stainless steel.

13. A rotary piston x-ray tube as claimed in claim 1 wherein said shell wall has a thickness in a range between 1 mm to 3 mm.

14. A rotary piston x-ray tube as claimed in claim 1 wherein said radially-rotating section of said shell wall has a thickness, and wherein said anode occupies only a portion of said thickness.

* * * * *